United States Patent [19]

Berstein et al.

[11] Patent Number: 4,485,537

[45] Date of Patent: Dec. 4, 1984

[54] MACHINE FOR THE MACHINING OF CRANKSHAFTS

[75] Inventors: Garri Berstein; Willy Hansen, both of Erkelenz, Fed. Rep. of Germany

[73] Assignee: Wilhelm Hegenscheidt GmbH, Erkelenz, Fed. Rep. of Germany

[21] Appl. No.: 412,598

[22] Filed: Aug. 30, 1982

[30] Foreign Application Priority Data

Jun. 28, 1982 [DE] Fed. Rep. of Germany ..... 3224268

[51] Int. Cl.[3] ..... B21K 1/08; B21D 21/00

[52] U.S. Cl. ..... 29/6; 72/107; 72/110

[58] Field of Search ..... 29/6, 558; 72/107, 108, 72/110

[56] References Cited

U.S. PATENT DOCUMENTS

| | | | |
|---|---|---|---|
| 3,590,469 | 7/1971 | Rohs | 29/6 |
| 3,735,620 | 5/1973 | Naumann | 29/6 |
| 3,948,076 | 4/1976 | Eitel et al. | 29/6 |
| 4,326,323 | 4/1982 | Kralowitz et al. | 29/6 |
| 4,437,328 | 3/1984 | Wittkopp et al. | 29/6 |

*Primary Examiner*—Howard N. Goldberg
*Assistant Examiner*—Steven E. Nichols
*Attorney, Agent, or Firm*—Arthur B. Colvin

[57] ABSTRACT

Known machines for the machining of crankshafts, in which the machining units for the machining of the crankshaft are supported and moved by operating crankshafts, are not adjustable to different offset angles of crankshafts to be machined. Therefore a machine is proposed for the machining of crankshafts with means for the guiding and taking along of a crankshaft to be machined and with at least two movable devices for the uptake of machining tools or systems, the devices being supported and moved by crankpins of two driven operating crankshafts consisting of several cranks and mounted on main bearing pins, where the individual cranks of each operating crankshaft are fixable relatively to each other and comprise two independent main bearing pins each and are mounted thereon for rotation relative to each other.

13 Claims, 4 Drawing Figures

MACHINE FOR THE MACHINING OF CRANKSHAFTS

Figure 1:
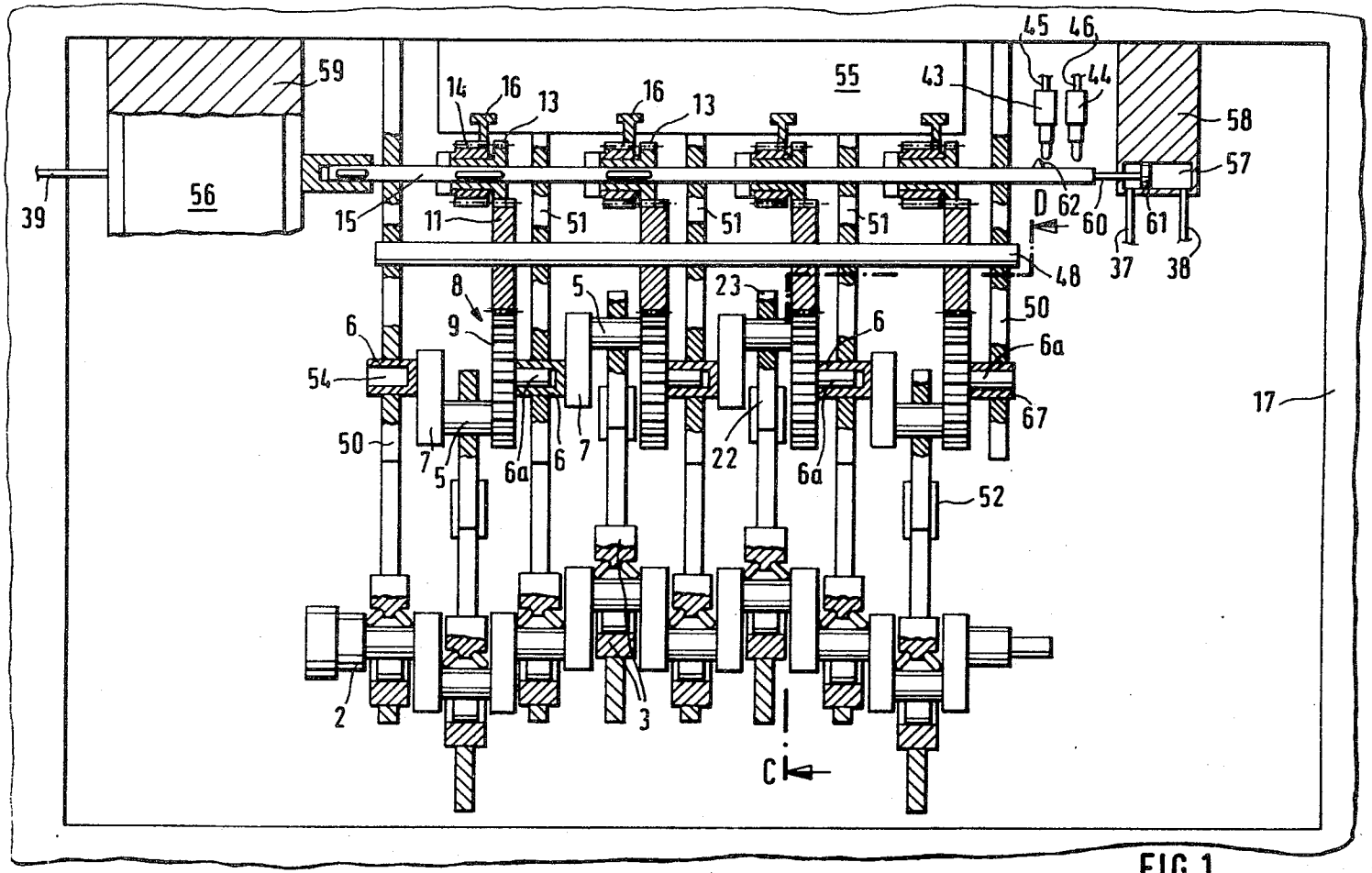

The invention relates to a machine for the machining of crankshafts with means for the guiding and rotating of a crankshaft to be machined and with at least two movable devices for the support of machining tools or system, the devices being supported and moved by crankpins of two driven operating crankshafts consisting of several cranks and mounted on main bearing pins.

Machines of the above named kind have become known in the form of crankshaft rolling machines for example from German Patent DE-PS No. 10 70 599 or DE-PS No. 11 18 645. These machines have proved successful in the practice for many years. Their decisive deficiency is, however, that because of their design they can machine only crankshafts of a very specific type—namely the type for which they are designed. In production practice, however, one comes across crankshafts where the angle positions of the stroke bearings are different while their other dimensions may be the same. As the known machines can machine only a very specific type of crankshaft, a specific rolling machine is required for each type. This is the more undesirable as said crankshaft rolling machines have a short cycle, so that they are not fully utilized by the occurring quantities to be assigned to them.

Through Bulletin C4/O on Crankshaft Rolling Machines Type 7898 of the firm W. Hegenscheidt KG, Werkzeugmaschinenfabrik (Maching Tool Makers), Erkelenz, crankshaft rolling machines with smooth or fixed rolls have further become known with which crankshafts with changing angular positions of the stroke bearings can be rolled in manual operation. However, since in these machines the rolling devices and rolling tools are moved by the workpiece to be rolled itself, they are unsuitable for automatic operation in quantity production. Adjustment of this machine to certain offset angles, to be maintained for several workpieces, is not possible with the machines named.

From DE-P No. 31 08 717, which is not a prior publication, a crankshaft rolling machine has become known where the movable rolling devices and tools can be adjusted for any desired offset angles.

The necessary lateral scope of the movable rolling tool supporting device is of undesirable dimension.

It is therefore an object of the invention to provide a machine for the machining of crankshafts which is minimized at least in the lateral scope of the needed construction elements and can be adjusted for any desired offset angles and which can be set up for different degrees of automation as needed.

According to the invention, this problem is solved in that the individual cranks of each operating crankshaft are fixable relative to each other and comprise pairs of independent main bearing pins and are mounted on them for rotation relative to each other. This design permits a coaxial arrangement and even nesting of the individual cranks, which yet remain independent of each other and can be mutually rotated. To accommodate the drive of the individual independent cranks does not require additional space because the immediate region of the crank cheek, needed anyway, is used for this. At the same time, through the drive—but not through it alone—the relative mutual fixability can be accomplished.

According to one embodiment of the invention, it is proposed that there is formed at each crank a region of a crank cheek as a drive element coaxial to the main bearing pin and is connectable with drive means to be actuated by control systems. It thus becomes possible to initiate drive and displacement motion directly in the region of the crank cheeks.

According to another embodiment of the invention, it is provided that the drive element is a toothed rim secured concentrically with the main bearing pin. A toothed rim is the simplest and most compact structural element combined with highest safety of operation.

According to a further embodiment of the invention, it is provided that the toothed rim is secured to the crank cheek. In this manner the individual cranks can be constructed in production independently of their desired later drive mode. The toothed rim itself here forms a wear part which for greatest compactness is disposed on the crank cheek and can be used either in a gear drive or in a chain drive, depending on the form of the teeth. Naturally it is not intended to rule out—and this should be expressly pointed out—that this toothed rim may be replaced by a toothed rim for a toothed belt as an alternative to the chain. Similarly a V-belt pulley may be used as an alternative to the toothed rim.

A further embodiment provides that the crank cheek is designed as a gear concentric with the main bearing pin. This results in the most compact construction, and for relatively small crankshafts it is a favorable realization of the drive of the separate cranks.

A further embodiment of the invention provides that drive means are provided both for a common drive of all cranks of both operating crankshafts and for separate drive of any one pair of cranks assigned to a movable device. By this measure the drive for the machining of a workpiece is separated from the drive for the adjustment of the tools to different offset positions of the workpiece.

According to a supplementary embodiment, it is provided that independent actuating means are provided both for the drive means for the common drive and for the drive means for the separate drive. Thereby the means or systems actuating the drive means can be better adapted to their specific functions, resulting in a simplification in terms of control as well as design.

Again according to an embodiment of the invention it is provided that with each drive element there meshes as drive means a gear mounted rotatably but non-displaceably, each of which can be rotationally driven by rotationally drivable gears. In this way the rotational drive of the devices as well as the displacement drive of the devices can be taken care of through a simple gear train.

According to a supplementary embodiment of the invention, it is provided that the rotationally drivable gears are arranged on a common shaft which is rotationally drivable and axially displaceable at least partially and that they form gear pairs, of which one gear is non-rotational and axially non-displaceable while the other gear meshing also with a correspondingly toothed actuating system. This is a structurally especially favorable possibility to separate the rotational motion and the displacing motion when these motions are initiated through a gear train.

A further variant of the invention provides that the actuating system comprises displaceable racks which mesh with the rotatable gears. A rack is a simple and cheap structural element and can be guided very easily.

In conjunction with the rotatable gear there results an extremely simple system, easy to control, for the angular adjustment of the offset positions of the individual cranks.

Still another embodiment of the invention provides that the control system is connected with at least one displacement transducer for determining a control path or equivalent quantity. This makes it possible to establish the adjustment of the offset angles automatically via a computer or automatically to move into a desired offset angle position. Naturally the measurement results of the transducers can be made visible on indicating devices, so that a certain position can be gone into manually if necessary.

Another embodiment of the invention provides that each rack is connected with a linear displacement transducer for establishing at least the displacement path of the rack. This is the simplest way to establish a control path.

Still another embodiment of the invention provides that for the displacement of the rack a gear motor with a pinion meshing with the rack is provided, the rotary motion produced by the gear motor being picked up by an angle-of-rotation transducer for determining the rack displacement. In this way the rack can easily be brought into a precise position and be held there and simultaneously the position of the rack and the change of position of the rack can be determined via an angle-of-rotation transducer by known and simple means.

According to still another embodiment of the invention, it is provided that rotationally drivable gears are arranged on a common rotationally drivable shaft axially undisplaceable and connectable therewith non-rotationally, and with each rotationally drivable gear a correspondingly toothed actuating system can be brought into operating contact. This is an alternative involving little expense for construction, with which an axially displaceable shaft can be avoided if this appears desirable.

Lastly it is provided according to an embodiment of the invention that the actuating system comprises a support arranged for at least limited displacement parallel to the drivable shaft, on which support racks guided for displacement perpendicular to the shaft are arranged. Also by this possibility the axially displaceable shaft can be avoided, and instead a displaceable support is used, the displaceability of which can be established more easily and for greater load capacity.

The invention will now be explained more specifically with reference to the annexed drawings, which show merely one example of realization.

Figure 2:
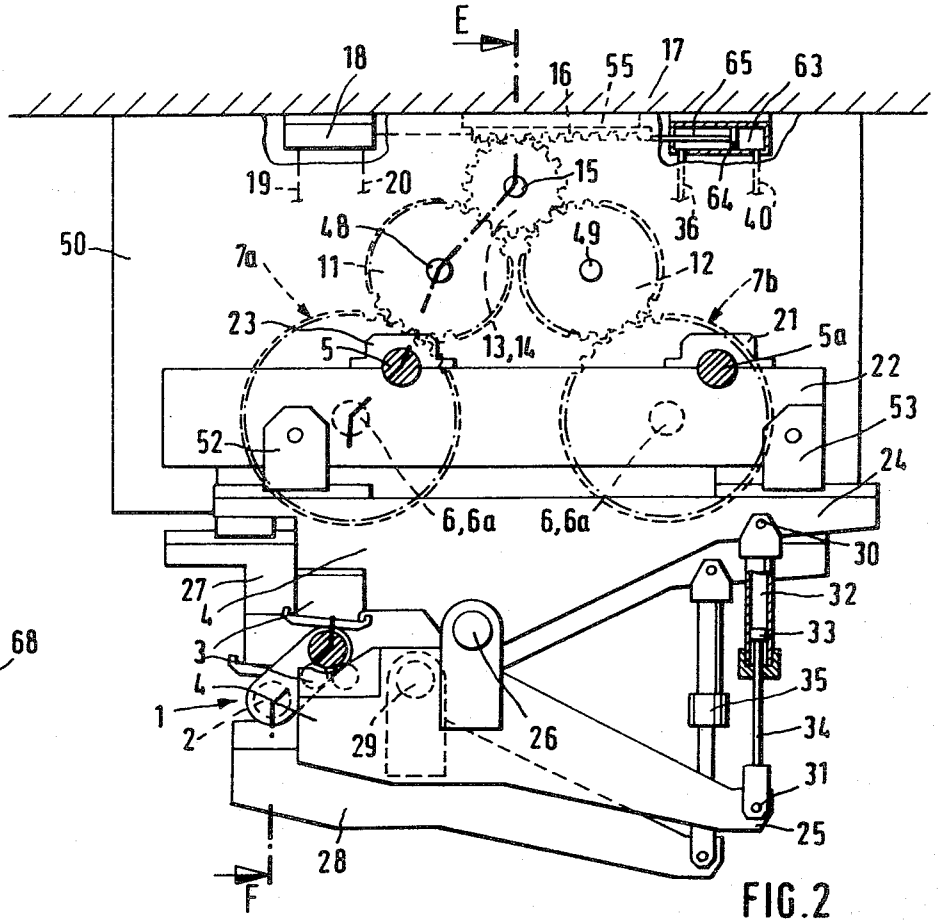
Figure 3:
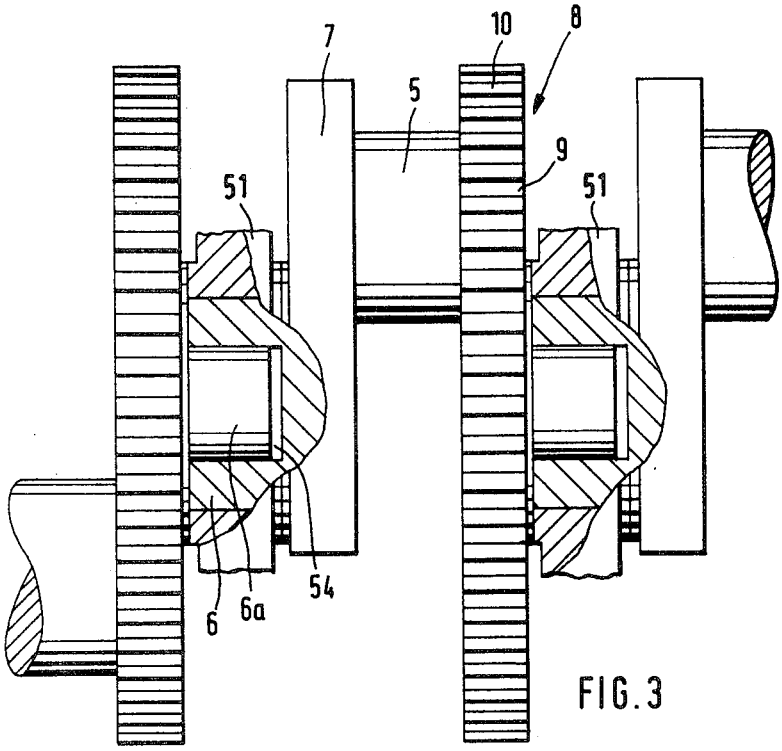

FIG. 1 is a front view of a crankshaft machining machine in section along line E-F of FIG. 2;

FIG. 2, a section along line C-D of FIG. 1;

FIG. 3, a representation of separate cranks mounted one in the other;

FIG. 4, control.

In a machine housing 17, in support walls 50 and 51 secured to the machine housing 17, the cranks 7 are rotatably mounted on their main bearing pins 6 and 6*a* for mutual rotation.

In the example of realization, each crank section 7 of the crankshaft 7*a*, 7*b* comprises a crank cheek 9 which is formed as a gear 10 concentric with the main bearing pin 6, 6*a* and having an external toothing (FIG. 3). Naturally it would readily be possible also to connect for example a toothed rim non-rotationally with a correspondingly formed crank cheek in the region 8 of the crank cheek 9. Meshing with gear 10 of each crank cheek 9 are gears 11 and 12, which are mounted on axles 48, 49 rotatably but axially non-displaceably, namely for the gears 10 of crankshaft 7*a* the gears 11, and for the gears 10 of crankshaft 7*b* the gears 12. The axles 48 and 49 are secured in the support walls 50 and 52.

The gear pairs formed by the gears 11 and 12 jointly mesh with a gear 13, all gears 13 being arranged on a shaft 15 non-rotationally and axially undisplaceably. Next to gear 13, on a slide bushing not specifically designated, a further gear 14 is mounted on the shaft axially undisplaceably but rotatably. With each gear 14 there meshes a rack 16, which racks are arranged to slide in a guide plate 55 secured to the machine housing 17.

Shaft 15 is mounted rotatably and axially displaceably in the support walls 50, 51 and can be set in rotation by the motor 56. The motor 56 can be mounted on a bracket 59 connected with the machine housing 17.

At the other end of shaft 15, by means of a clutch not shown in detail which permits a rotational movement, the shaft is connected with the piston rod 60 of the hydraulic cylinder 57, which likewise may be arranged on a bracket 58 connected with the machine housing 17. Displacement of piston 61 in hydraulic cylinder 57 causes a corresponding displacement of shaft 15 through the piston rod 60.

Approximately between bracket 58 and the right support wall 50, two limit switches 43 and 44 are arranged, which can be actuated by a cam 62 disposed on shaft 15.

In the example of realization, the racks 16 are connected on the one hand with a linear displacement transducer 18 and on the other with a hydraulic cylinder 63. Transducer 18 and cylinder 63 are suitably connected with the machine housing 17.

The crankpins 5 and 5*a* of each crank 7 of the crankshafts 7*a* and 7*b* are rotatably connected with a support 22 via bearing boxes 21 and 23. In this way each support 22 forms a connecting rod between the crankpins 5 and 5*a* of each successive pair of cranks 7 of the respective crankshaft 7*a* and 7*b*.

Each movable rolling device 4 is connected by its two-sided lever 24 secured through clamping plates 52 and 53 to the respective support 22, via the bearing boxes 21 and 23, with the described crankpins 5 and 5*a*, and thus is mounted, moved and supported by them. An additional two-sided lever 25 per rolling device 4 is connected through a pin 26 with the first two-sided lever 24. Both two-sided levers 24 and 25 carry at their one end parts of a known rolling tool 3 associated with one another in known manner. At the other end of the two-sided lever 24 there is secured through a joint 30 a hydraulic cylinder 32 in which slides a piston 33 which through a piston rod 34 is connected with the two-sided lever 25 via a joint 31. In the same manner a hydraulic cylinder 35 is connected with the two-sided levers 27 and 28 of an immobile rolling device serving as guide and uptake 1 of a workpiece. To this end, likewise known rolling tools are arranged at the free ends thereof. Each two-sided lever 27 of each immobile rolling device serving as guide and uptake 1 is secured to the machine housing 17 by a support wall 50, while each movable rolling device 4 is secured in the above described manner to the crankpins 5 and 5*a* and therefore moves with them.

To be able to receive a crankshaft 2 to be machined, in the starting position the pistons of the hydraulic cylinders 32 and 35 are pushed in, so that on the other side of the two-sided levers 24, 25; 27, 28 the rolling tools disposed there stand open like a mouth. Now the crankshaft 2 to be rolled is inserted manually or automatically into the lower parts of the rolling tools arranged on the two-sided levers 25, 28. Thereafter, by actuation of the hydraulic cylinders 35 by way of the two-sided levers 27 and 28 first the rolling tools of the immobile rolling devices are moved together, which thus embrace the main bearing pins of crankshaft 2, thus guiding and receiving them. Thereafter the hydraulic cylinders 32 are actuated and thereby, by way of the two-sided levers 24 and 25, the rolling tools 3 of the movable rolling devices 4 are brought together, which then apply against the crankpin of crankshaft 2 to be rolled. This is done in known manner, so that here details of the description of the hydraulic control for the hydraulic cylinders 32 and 35 can be dispensed with.

To perform a machining of crankshaft 2 in the example of realization, pressurizing the connecting line 39 of the machine control 66 switches motor 56 on, which thereby sets all gears 13 into rotation via shaft 15. Each of these gears 13 in turn drives two gears 11 and 12 associated with it, and they in turn drive by a gear 10 a crank cheek 9 of a crank section 7, of which one crank 7 is associated with crankshaft *7a* and the other with crankshaft *7b*. In this manner all cranks of crankshafts *7a* and *7b* are rotated simultaneously in the same direction and exactly at the same speed. Thereby the relative angular position of the crankpins 5 and *5a* of all crank section 7 is maintained.

In the example of realization, each crank section 7 comprises on one side a main bearing pin 6 and on the other side a main bearing pin *6a*. Each main bearing pin 6 has a bore 54, whose diameter is such that the main bearing pin *6a* fits into this bore and can be mounted rotatably therein. In this way all cranks 7 can be inserted and mounted one in the other in a compact manner and together they form the respective crankshaft *7a*; *7b*. This crankshaft *7a*, *7b* is rotatably mounted on its main bearing pin—as has been described before—through bores in the support walls 50 and 51. In order that the bores in the support walls 50 and 52 for the rotatable suspension of the crankshaft *7a*, *7b* can all be the same, support wall 50 for example, in which the last crank 7 with the main bearing pin *6a* of smaller diameter must be mounted, may comprise a slide bushing 67 of corresponding dimension, to compensate the diameter difference between the bearing bore and the main bearing pin *6a*. In crankshafts *7a*, *7b* of such design, each individual crank is mounted rotationally relative to each other crank 7. Fixing of the relative position is effected in the example of realization through the drive.

Figure 4:
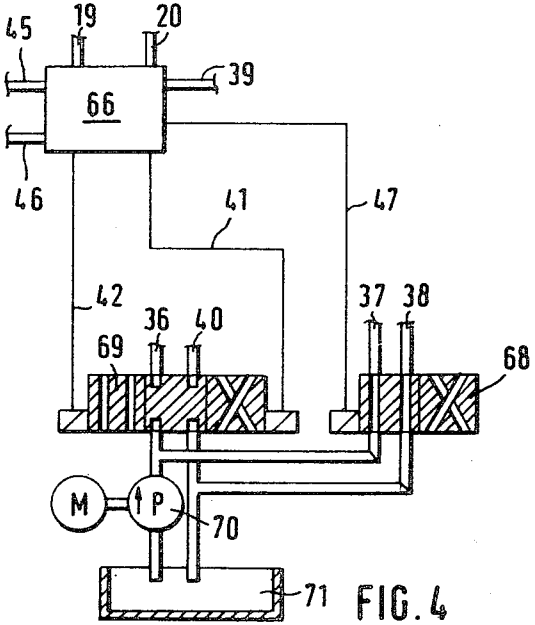

Now if a crankshaft 2 is to be machined with offset angles different from the previous crankshaft 2, the individual cranks 7 must be correspondingly rotated relative to each other, so that the position of the crankpins 5, *5a* again corresponds to those of the crankshaft 2 to be machined. To achieve this, valve 68 is brought, by the machine control 66, into the position shown in FIG. 4 via control line 47 while the machine stands still, so that hydraulic oil can be pumped by pump 70 from tank 71 via connecting line 37 into the cylinder space to the left of piston 61 of hydraulic cylinder 57, whereby piston 61 moves to the right into hydraulic cylinder 57, the excess hydraulic oil being ejected via connecting line 38 through valve 68 into tank 71. By the movement of piston 61, via the piston rod 60 connected with piston 61, shaft 15 is moved axially in corresponding manner, so that cam 62 leaves the limit switch 43, whereby via the connecting line 45 a corresponding signal is sent to the machine control 66. After a sufficient axial movement of shaft 15, limit switch 44 is actuated by cam 62, and thereby again a corresponding signal is sent via connecting line 46 to the machine control 66, whereby it is signalized that shaft 15 has now reached the desired axial position. By the described axial displacement of shaft 15 gears 14 now come into operating contact with the gears 11 and 12, while at the same time gears 13 lose this operating contact with gears 11 and 12. But despite the axial displacement of shaft 15 and hence of gears 13 and 14 disposed on it, the racks 16 remain in operating contact with the gears 14 which are wide enough for this, so that now a connection is established from racks 16 via gears 14 and gears 11 and 12 to the gears 10 of the crank cheeks 9 to the individual crank sections 7 of the operating crankshafts *7a* and *7b*. This connection now permits the rotation of a pair of cranks 7 connected via the support 22 relative to each other crank pair thus produced in its angular position, giving assurance at the same time that the individual cranks 7 of a crank pair belonging together cannot change their relative angular position, but also are fixable relatively to each other.

Now in order to achieve an angle rotation of the various crank pairs relative to other associated crank pairs, the rack 16 belonging to the respective crank pair to be adjusted must be axially displaced in the guide plate 55. To this end, a corresponding switching pulse is delivered by the machine control 66 either via control line 41 or via control line 42 to the switching magnets of valve 69, so that the latter is switched from its blocking central position either into the parallel switching position or into the crossed switching position, whereby piston 64 of hydraulic cylinder 63 is pressurized with pressure oil via lines 36, 40 and is thereby caused to move either to the left or to the right and therewith to move rack 16 correspondingly via piston rod 56. Rack 16 is connected at the same time with a linear displacement transducer 18, which is connected via lines 19 and 20 with the machine control 66, so that the exact position and hence also the necessary position changes of rack 16 can be established directly through the machine control 66, which may be connected with an appropriate computer. On the basis of such a finding, the machine control is then able to actuate valve 69 in suitable manner. If such a computer, which per se is known as to its construction, is connected with the machine control 66, a desired angle position of the individual cranks 7 can be fed into the machine control, which then automatically carries out the necessary switching operations for changing the position of the individual crank parts of the individual cranks 7 relative to each other and determines the actual position and the moving into the desired position via the linear displacement transducer 18 and upon reaching the desired position fixes the same for example by moving valve 69 to the central position and by axial return of shaft 15 to the starting position. To push shaft 15 axially back into the starting position, it suffices to do the reverse of what was done before as described in connection with the first axial displacement.

With the described machine such crankshaft machining devices, which are carried, moved and mounted through two operating crankshafts, can be adjusted to any desired offset positions of the crankshaft to be machined, manually, semiautomatically or fully automatically as desired. In axial direction the construction can be extremely compact, and it is easily possible to retool the machine in an extremely simple manner also to crankshafts with different stroke bearing numbers by fitting together or eliminating individual crank pairs. It is thus possible at the same time to provide for simple stock-keeping of parts, which can then be assembled to machines for crankshafts with different stroke bearing numbers without having to pay attention to the offset of the crankshaft to be machined.

We claim:

1. In a crank rolling machine adapted to be adjusted for rolling of the crank fillets of cranks of a variety of different angular configurations, said machine including means for rotatably supporting a crankshaft to be rolled, rolling means for applying rolling forces to said fillets, first and second control crankshafts operatively connected to said rolling means for controlling the rotated position of said crankshaft to be rolled in accordance with the rotated position of said control crankshafts, drive means for synchronously rotating said control crankshafts and said crankshaft to be rolled, the improvement which comprises said control crankshafts each comprising a plurality of crank sections, said sections being relatively rotatably adjustable one to the other about the axis of rotation of said control crankshafts, whereby the angular orientation of the crank sections of said control crankshafts can be adapted to process crankshafts of a variety of configurations.

2. A crankshaft rolling machine in accordance with claim 1 wherein said crankshaft sections include main bearing pins, a bearing pin of each said sections being rotatably mounted in a bearing pin in an adjacent section.

3. A crankshaft rolling machine in accordance with claim 2 wherein said crankshaft sections include toothed drive rim portions concentric to said main bearing pins, the combination including toothed locking means shiftable between a locking position whereat said sections are linked against relative rotation, and an adjustment position whereat said sections are freed for relative rotation about the axis of said main bearing pins.

4. A crankshaft rolling machine in accordance with claim 3 wherein said crank sections inlcude a crank cheek, and said toothed rim portions are formed on said crank cheeks.

5. A crankshaft rolling machine in accordance with claim 3 wherein said toothed portions define gears.

6. A crankshaft rolling machine in accordance with claim 5 wherein said locking means comprises a gear train assembly mounted on shafts rotatable about axes parallel to said main bearing pins of said crank sections.

7. A crankshaft rolling machine in accordance with claim 5 wherein said locking means comprises first and second shafts mounted for rotation about spaced parallel axes parallel to the axes of said main bearing pins, a plurality of gears fixed to each of said shafts, said gears each being meshed with a gear of one of said crank sections, a third shaft mounted for rotation about an axis parallel to said first and second shafts, a plurality of gears fixed to said third shaft, said third shaft being axially shiftable between a locking position whereat each gear of said third shaft is meshed with a gear of said first and second shafts, and an adjustment positions whereat said gears of said third shaft are decoupled from said gears of said first and second shafts.

8. Apparatus in accordance with claim 7 wherein said drive means is adapted to rotate said third shaft and thus in said locking position to rotate said operating shafts through said gear train assembly.

9. Apparatus in accordance with claim 8 wherein said third shaft carries a plurality of adjustment gears rotatably mounted thereon and axially fixed thereto, each said adjustment gear, in said adjustment position, being coupled with a gear of said first and second shafts.

10. Apparatus in accordance with claim 9 and including means for individually rotating said adjustment gears in said adjustment position of said third shaft to thereby relatively rotate said crank sections of said control crankshafts.

11. Apparatus in accordance with claim 10 wherein said means for relatively rotating said adjustment gears comprise rack members meshed with said adjustment gears.

12. Apparatus in accordance with claim 11 and including linear motor means for shifting said rack members a predetermined distance to thus effect a predetermined rotation of said adjustment gears.

13. Apparatus in accordance with claim 12 and including automatic control means for controlling the displacement of said linear motor means and hence the degree of rotation of said adjustment gears.

* * * * *